US007712863B2

(12) United States Patent
Shimazaki

(10) Patent No.: US 7,712,863 B2
(45) Date of Patent: May 11, 2010

(54) LIQUID-EJECTING-APPARATUS MAINTENANCE METHOD AND LIQUID EJECTING APPARATUS

(75) Inventor: Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 12/027,836

(22) Filed: Feb. 7, 2008

(65) Prior Publication Data

US 2008/0192085 A1 Aug. 14, 2008

(30) Foreign Application Priority Data

Feb. 13, 2007 (JP) ..... 2007-032558

(51) Int. Cl.
*B41J 2/165* (2006.01)

(52) U.S. Cl. ..... 347/23; 347/36; 347/35

(58) Field of Classification Search ..... 347/19, 347/22, 23, 35, 36
See application file for complete search history.

(56) References Cited

U.S. PATENT DOCUMENTS 7,568,780 B2 * 8/2009 Nishihara et al. ..... 347/19
2006/0152543 A1 * 7/2006 Komatsu et al. ..... 347/19
2008/0180482 A1 * 7/2008 Shimazaki ..... 347/23

FOREIGN PATENT DOCUMENTS

| | | | |
|---|---|---|---|
| JP | 2006-142554 | | 6/2006 |
| JP | 2006-248132 | | 9/2006 |
| JP | 2006-264243 | | 10/2006 |
| JP | 2004-167430 | | 6/2007 |
| JP | 2007-160671 | * | 6/2007 |
| JP | 2007-176152 | | 7/2007 |

* cited by examiner

*Primary Examiner*—Huan H Tran
(74) *Attorney, Agent, or Firm*—Workman Nydegger

(57) ABSTRACT

A maintenance method that discharges liquid L collected in a liquid receiver 15 of a liquid ejecting apparatus includes a first step of causing a nozzle opening face 43*a* of a liquid ejecting head 3 to be disposed facing the liquid receiver 15 in a non-contact state and applying an electric field between both, a second step of ejecting liquid D from a nozzle 47 to the liquid receiver 15, a third step of detecting a voltage change based on electrostatic induction at the time of ejecting the liquid D to the liquid receiver 15, a fourth step of determining a liquid level height H of the liquid L collected in the liquid receiver on the basis of a result of detection of the voltage change, and a fifth step of discharging the liquid L collected in the liquid receiver when the liquid level height H reaches a predetermined height.

14 Claims, 10 Drawing Sheets

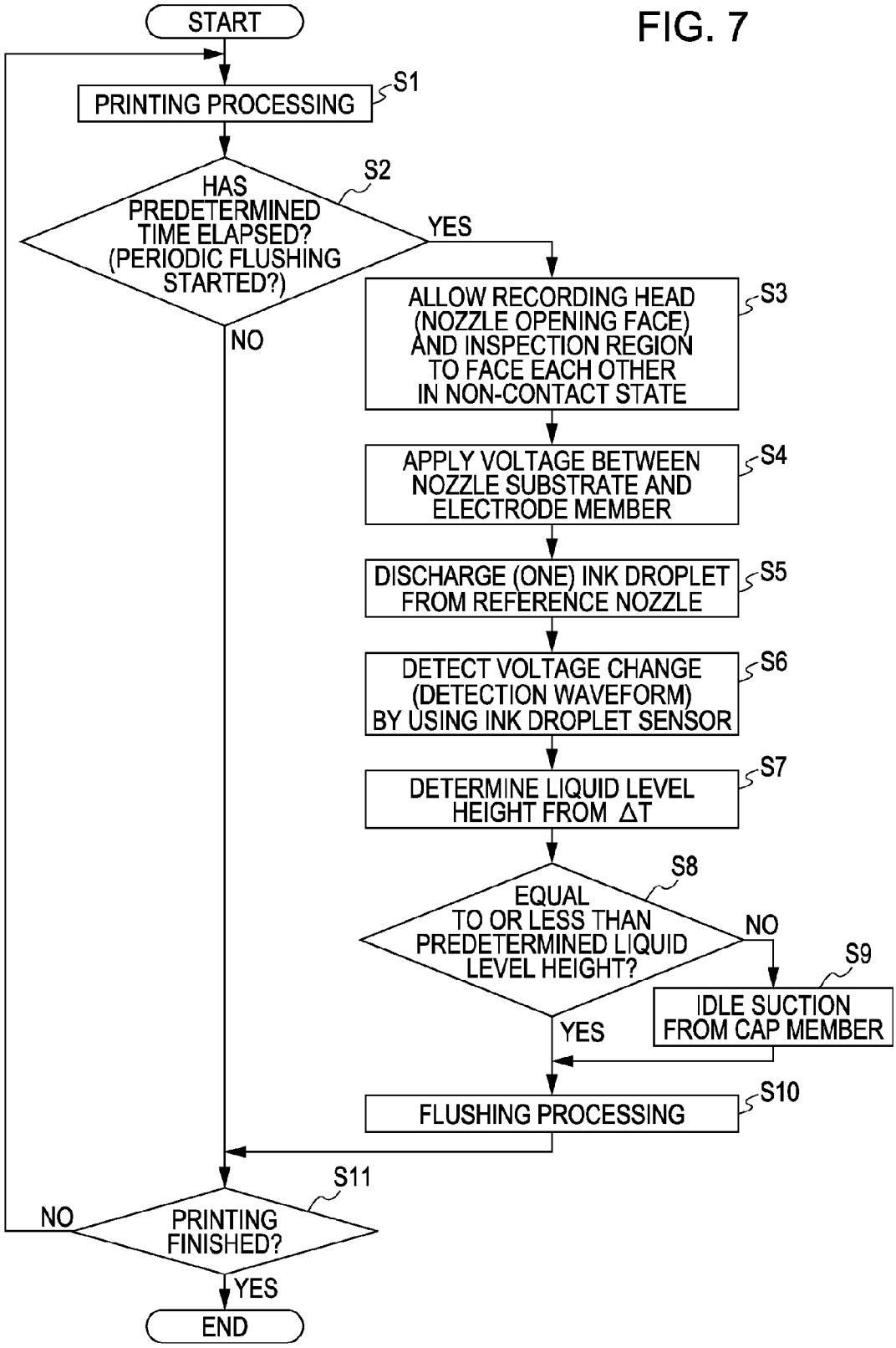
FIG. 7
START
PRINTING PROCESSING
S1
HAS PREDETERMINED TIME ELAPSED? (PERIODIC FLUSHING STARTED?)
S2
YES
NO
ALLOW RECORDING HEAD (NOZZLE OPENING FACE) AND INSPECTION REGION TO FACE EACH OTHER IN NON-CONTACT STATE
S3
APPLY VOLTAGE BETWEEN NOZZLE SUBSTRATE AND ELECTRODE MEMBER
S4
DISCHARGE (ONE) INK DROPLET FROM REFERENCE NOZZLE
S5
DETECT VOLTAGE CHANGE (DETECTION WAVEFORM) BY USING INK DROPLET SENSOR
S6
DETERMINE LIQUID LEVEL HEIGHT FROM ΔT
S7
EQUAL TO OR LESS THAN PREDETERMINED LIQUID LEVEL HEIGHT?
S8
NO
YES
IDLE SUCTION FROM CAP MEMBER
S9
FLUSHING PROCESSING
S10
PRINTING FINISHED?
S11
NO
YES
END

LIQUID-EJECTING-APPARATUS MAINTENANCE METHOD AND LIQUID EJECTING APPARATUS

The entire disclosure of Japanese Patent Application No. 2007-032558, filed Feb. 13, 2007, is expressly incorporated by reference herein.

BACKGROUND OF THE INVENTION

1. Field of the Invention

The present invention relates to a maintenance method for use in a liquid ejecting apparatus such as an ink jet printer, and an ink jet printer.

2. Description of the Related Art

Liquid ejecting apparatuses have liquid ejecting heads capable of ejecting liquids as droplets, and eject various types of liquids from the ejecting heads.

Examples of typical liquid ejecting apparatuses include an image recording apparatus, such as an ink jet printer, having an ink jet recording head (hereinafter referred to simply as a recording head) as a liquid ejecting head, for performing recording by forming dots in such a manner that liquid ink is allowed to be discharged as ink droplets from nozzles (openings) of the recording head and to land on a discharge target such as recording paper.

In recent years, the liquid ejecting apparatuses have been applied not only to the image recording apparatuses but also to various manufacturing apparatuses such as an apparatus for manufacturing color filters of liquid crystal displays, etc.

In such an image recording apparatus, for example, ink stored in a liquid reservoir such as an ink tank or an ink cartridge is introduced into a pressure chamber of a recording head, and a driving signal is applied to drive a pressure generating source such as a piezoelectric vibrator, whereby a pressure change is caused to occur in the ink in the pressure chamber. By controlling the pressure change, an ink droplet can be discharged from a nozzle.

Regarding the recording head, on the basis of a driving voltage (potential difference from the lowest voltage to the highest voltage) of the driving signal supplied to the pressure generating source and a waveform thereof, a liquid amount (weight and volume) of an ink droplet discharged from the nozzle increases or decreases.

In a liquid ejecting apparatus, in order that each nozzle of the recording head may be maintained in a good state and that missing dots may be prevented from occurring in such a manner that a desired amount of ink droplets is always discharged, in a case such as before the start of recording (printing), during recording, or after finishing recording, so-called flushing processing in which, by discharging ink from each nozzle, ink having increased viscosity, etc., in the nozzle is discharged is performed The liquid discharged by the flushing processing collects in a tray-shaped liquid receiver. When a predetermined amount of the liquid has collected in the liquid receiver, a pump is driven to discharge the liquid to a discharge ink tank. This processing is called idle suction processing (Japanese Unexamined Patent Application Publication No. 2006-248132).

The liquid that collects in the liquid receiver needs to be discharged before overflowing the liquid receiver. However, since the amount of the liquid that collects in the liquid receiver cannot be directly measured, conventionally, the amount of the liquid that collects is indirectly determined on the basis of the amount of the liquid discharged from the nozzle of the recording head and the number of times discharging has been performed. At this time, the liquid amount discharged from the nozzle changes according to environmental conditions such as temperature and humidity, and the liquid amount varies. Thus, the liquid amount is determined assuming the worst conditions (a case where the liquid amount is the largest).

In addition, to ensure avoidance of liquid leaking from the liquid receiver, at the time the amount of the liquid that is collecting has reached a predetermined liquid amount less than the volume (for example, approximately 80% of the volume of the liquid receiver) of the liquid receiver, the pump is driven. In addition, the volume of the liquid receiver is determined assuming that, when a liquid absorber disposed in the liquid receiver is used, the liquid absorber is clogged.

Accordingly, even if the liquid receiver can still sufficiently store liquid, the pump is driven. In other words, there is a problem in that a frequency of pump driving increases.

In particular, in a case where a driving motor for a pump for discharging (suction) liquid from the liquid receiver is also used as a driving motor for a paper feeding mechanism for feeding and expelling recording paper to a recording head, when liquid is discharged from the liquid receiver, it is necessary to interrupt recording processing including paper feeding and expelling. Thus, there is a problem in that efficiency of the recording processing decreases.

SUMMARY

The present invention has been made in view of the above circumstances. It is an object of the present invention to provide a liquid-ejecting-apparatus maintenance method and a liquid ejecting apparatus in which a frequency of discharging liquid collecting in a liquid receiver can be reduced, and in which it is ensured that leaking of liquid from the liquid receiver can be avoided.

To solve the above problems, a liquid-ejecting-apparatus maintenance method and liquid ejecting apparatus according to the present invention employ the following means.

A first invention provides a maintenance method for a liquid ejecting apparatus that ejects liquid from a nozzle of a liquid ejecting head to a liquid receiver and that, when a predetermined amount of the liquid collects in the liquid receiver, discharges the predetermined amount of the liquid, the maintenance method including a first step of allowing a nozzle opening face of the liquid ejecting head and the liquid receiver to face each other in a non-contact state and applying an electric field between the nozzle opening face and the liquid receiver, a second step of ejecting the liquid from the nozzle to the liquid receiver, a third step of detecting a voltage change based on electrostatic induction at the time of ejecting the liquid to the liquid receiver, a fourth step of determining a liquid level height of the liquid collected in the liquid receiver, and a fifth step of discharging the liquid collected in the liquid receiver when the liquid level height reaches a predetermined height.

This can detect the amount of the liquid collected in the liquid receiver, and can optimize timing for performing the step of discharging the liquid collected in the liquid receiver. Therefore, a frequency of the liquid discharging step is reduced, so that an efficiency of recording processing with the liquid ejecting head can be increased. In addition, by reducing the frequency of the liquid discharging step, an improvement in durability of a suction pump for discharging the liquid can be achieved.

In addition, the liquid level height is determined on the basis of, as to the voltage change, a voltage change in a case where the liquid ejected from the nozzle lands in the liquid receiver.

In addition, the liquid level height is determined on the basis of a time after the voltage change occurs until a voltage peak is reached.

This can accurately detect the amount of the liquid collected in the liquid receiver, so that it is ensured that the frequency of the liquid discharging step can be reduced.

In addition, the first step through the fourth step are performed after the liquid ejected to the liquid receiver reaches an amount set beforehand.

This can reduce a frequency of executing the step of detecting the liquid level height of the liquid receiver.

In addition, the method includes, between the fourth step and the fifth step, a sixth step of performing flushing processing that continuously ejects the liquid from the liquid ejecting head to the liquid receiver. In the sixth step, the amount of liquid that can be ejected and/or the number of times the liquid can be ejected before the predetermined height is reached are/is determined.

This can estimate timing for implementing a liquid discharging step to be subsequently performed.

In addition, in the sixth step, the flushing processing is performed periodically and/or aperiodically a plural number of times.

In addition, in the sixth step, the number of times the flushing processing can be performed until the predetermined height is reached is determined.

This can ensure that the liquid discharging step is implemented before the liquid collected in the liquid receiver overflows.

In the sixth step, in a case where the flushing processing is flushing processing at a discharging time, the predetermined height is set to be higher compared with other flushing processing.

This can optimize timing for implementing the liquid discharging step.

A second invention provides a liquid ejecting apparatus that ejects liquid from a nozzle of a liquid ejecting head to a liquid receiver and that, when a predetermined amount of the liquid collects in the liquid receiver, discharges the predetermined amount of the liquid, the liquid ejecting apparatus including a liquid detecting unit that, in a case where a nozzle opening face of the liquid ejecting head the liquid receiver are disposed facing each other in a non-contact state, applies an electric field between the nozzle opening face and the liquid receiver, a flushing processing unit that continuously ejects the liquid from the liquid ejecting head to the liquid receiver, a liquid discharging unit that discharges the liquid collected in the liquid receiver, and a maintenance processing unit that determines a liquid level height of the liquid collected in the liquid receiver on the basis of a result of detection of the voltage change, and that drives the liquid discharging unit when the liquid level height reaches a predetermined height.

This can detect the amount of the liquid collected in the liquid receiver, so that timing for implementing the step of discharging the liquid collected in the liquid receiver can be optimized. Accordingly, a frequency of the liquid discharging step is reduced, so that an efficiency of recording processing with the liquid ejecting head can be improved. In addition, by reducing the frequency of the liquid discharging step, an improvement in durability of a suction pump for discharging the liquid can be achieved.

In addition, the maintenance processing unit determines the liquid level height on the basis of, as to the voltage change, a voltage change in a case where the liquid ejected from the nozzle lands in the liquid receiver.

In addition, the liquid level height is determined on the basis of a time after the voltage change occurs until a voltage peak is reached.

This can accurately detect the amount of the liquid collected in the liquid receiver, so that it is ensured that the frequency of the liquid discharging step can be reduced.

In addition, the maintenance processing unit determines the amount of liquid that can be ejected and/or the number of times the liquid can be ejected before the predetermined height is reached.

This can ensure that the liquid discharging step is implemented before the liquid collected in the liquid receiver overflows.

In addition, the flushing processing unit continuously ejects the liquid to the liquid receiver periodically and/or aperiodically a plural number of times.

In addition, the maintenance processing unit determines the number of times the flushing processing can be performed before the predetermined height is reached, and drives the liquid discharging unit on the basis of the number of times the flushing processing can be performed.

This can ensure that the liquid discharging step is implemented before the liquid collected in the liquid receiver overflows.

BRIEF DESCRIPTION OF THE DRAWINGS

FIG. 7 is a flowchart illustrating a maintenance process using an ink droplet sensor.

DESCRIPTION OF THE PREFERRED EMBODIMENTS

A first embodiment of a liquid-ejecting-apparatus maintenance method and liquid ejecting apparatus according to the present invention will be described below with reference to the drawings. In this embodiment, an ink jet printer (hereinafter referred to as a printer 1) is exemplified as a liquid ejecting apparatus according to the present invention.

Figure 1:
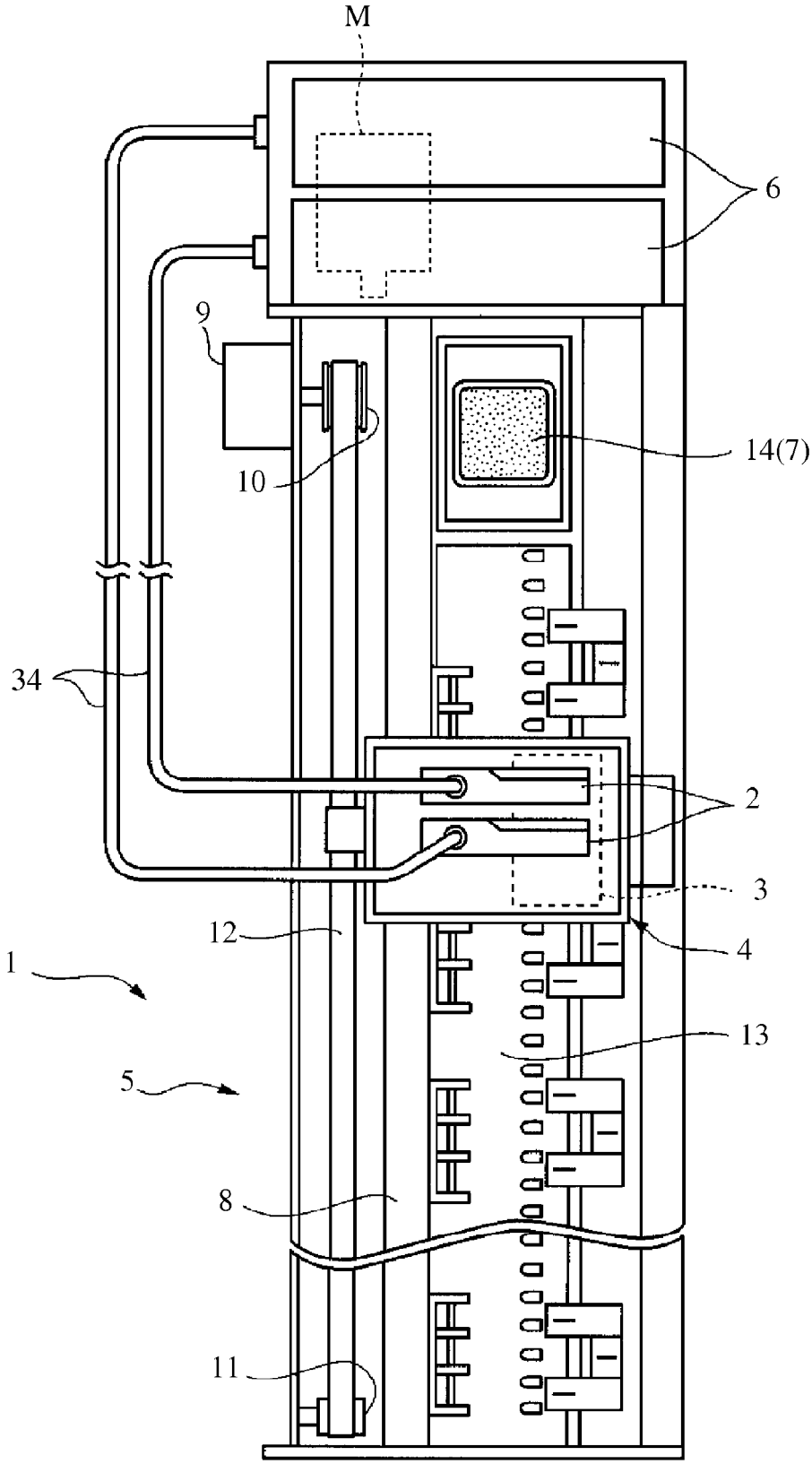
FIG. 1 is a perspective view illustrating the configuration of a printer.

FIG. 1 is a partially exploded view showing printer 1 according to the embodiment of the present invention.

The printer 1 broadly includes a carriage 4 provided with subtanks 2 and a recording head 3, and a printer body 5.

The printer body 5 includes a carriage moving mechanism 65 (see FIG. 5) for moving the carriage 4 in a reciprocating manner, a paper feeding mechanism 66 (see FIG. 5) for transporting recording paper, which is not shown, a capping mechanism 14 that is used in an operation such as a cleaning operation for sucking ink L whose viscosity is increased from each nozzle of the recording head 3, and an ink cartridge 6 that stores ink L to be supplied to the recording head 3.

In addition, the printer 1 includes an ink droplet sensor 7 (see FIGS. 4 and 5) capable of detecting an ink droplet D discharged from the recording head 3. The ink droplet sensor 7 is configured to charge the ink droplet D discharged from the recording head 3 and to output, as a detection signal, a voltage change based on electrostatic induction in a case where the charged droplet D flies.

Details of the ink droplet sensor 7 will be described later.

The carriage moving mechanism 65 includes a guide shaft 8 provided in a width direction of the printer body 5, a pulse motor 9, a driven pulley 10 which is connected to a rotating shaft of the pulse motor 9 and which is driven to be rotated by the pulse motor 9, an idling pulley 11 provided on the opposite side of the driven pulley 10 in the width direction of the printer body 5, and a timing belt 12 which extends between the driven pulley 10 and the idling pulley 11 and which is connected to the carriage 4.

The carriage 4 is configured so that, by driving the pulse motor 9, the carriage 4 moves in a reciprocating manner in a main scanning direction along the guide shaft 8.

In addition, the paper feeding mechanism 66 includes a paper feeding motor M and a paper feeding roller that is driven to rotate by the paper feeding motor M (both not shown). The paper feeding mechanism 66 sequentially feeds the recording paper onto a platen 13 in conjunction with a recording operation.

The capping mechanism 14 includes a cap member 15 and a suction pump 16. The cap member 15 is formed by a member obtained by shapening an elastic material into a tray shape, and is disposed at a home position. This home position is set to be within a moving range of the carriage 4 and to be in an end region outside a recording region. The home position is a position at which the carriage 4 is positioned in a power-off time and in a case where recording (liquid ejecting processing) is not performed for a long time.

In a case where the carriage 4 is positioned at the home position, the cap member 15 performs sealing by abutting against a surface (that is, a nozzle opening face 43*a*) of a nozzle substrate 43 (see FIG. 3) of the recording head 3. When the suction pump 16 is actuated in this sealing state, the inside (sealing hollow portion) of the cap member 15 is decompressed, so that the ink L in the recording head 3 is forcibly discharged from a nozzle 47.

In addition, in cases such as before a recording operation by the recording head 3 and during a recording operation by the recording head 3, in flushing processing that discharges the ink droplet D in order to discharge the ink L, whose viscosity is increased, bubbles, etc., the cap member 15 receives the ink droplet D.

Figure 2:
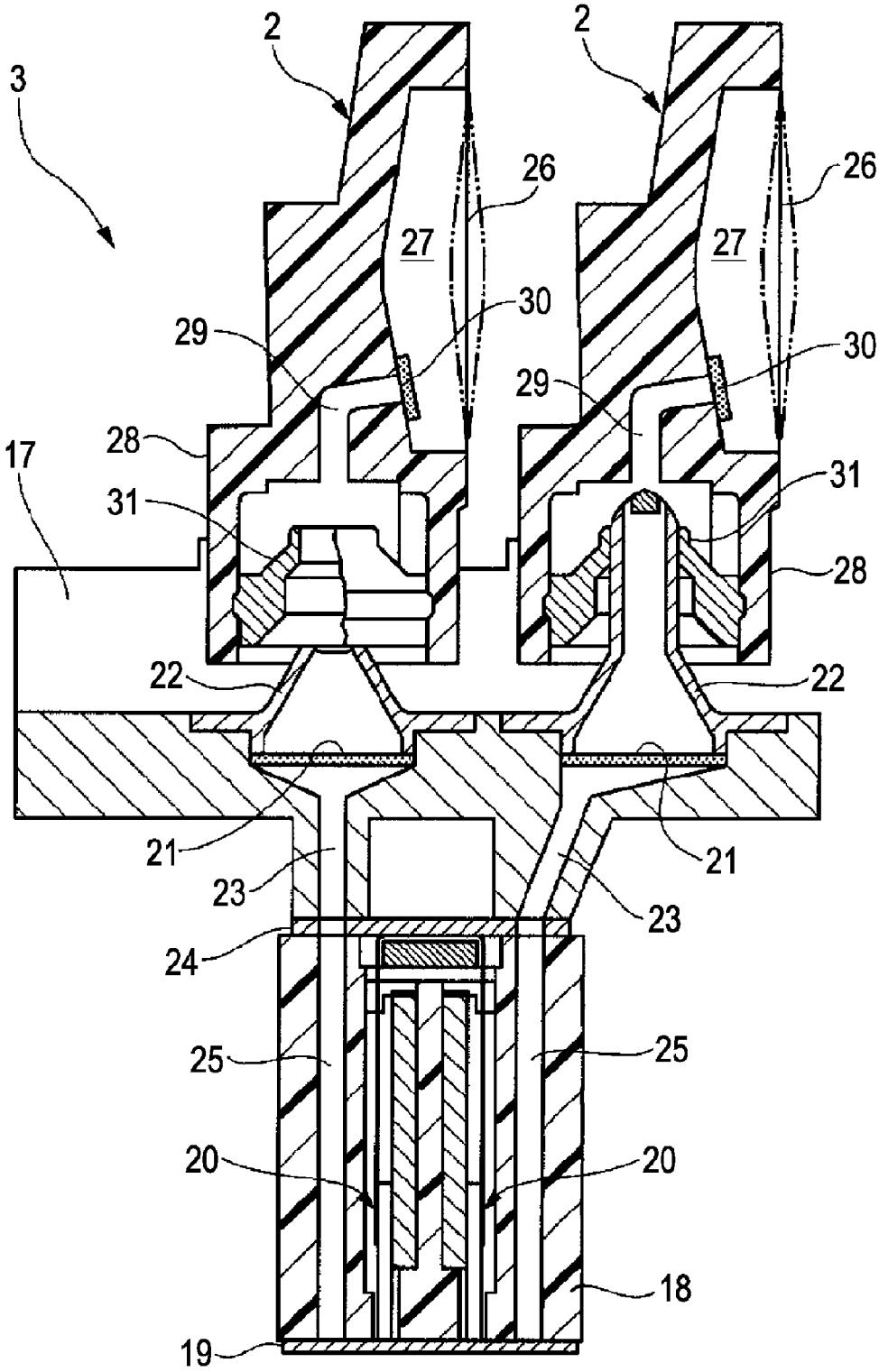
FIG. 2 is a section view illustrating the configuration of the recording head.
Figure 3:
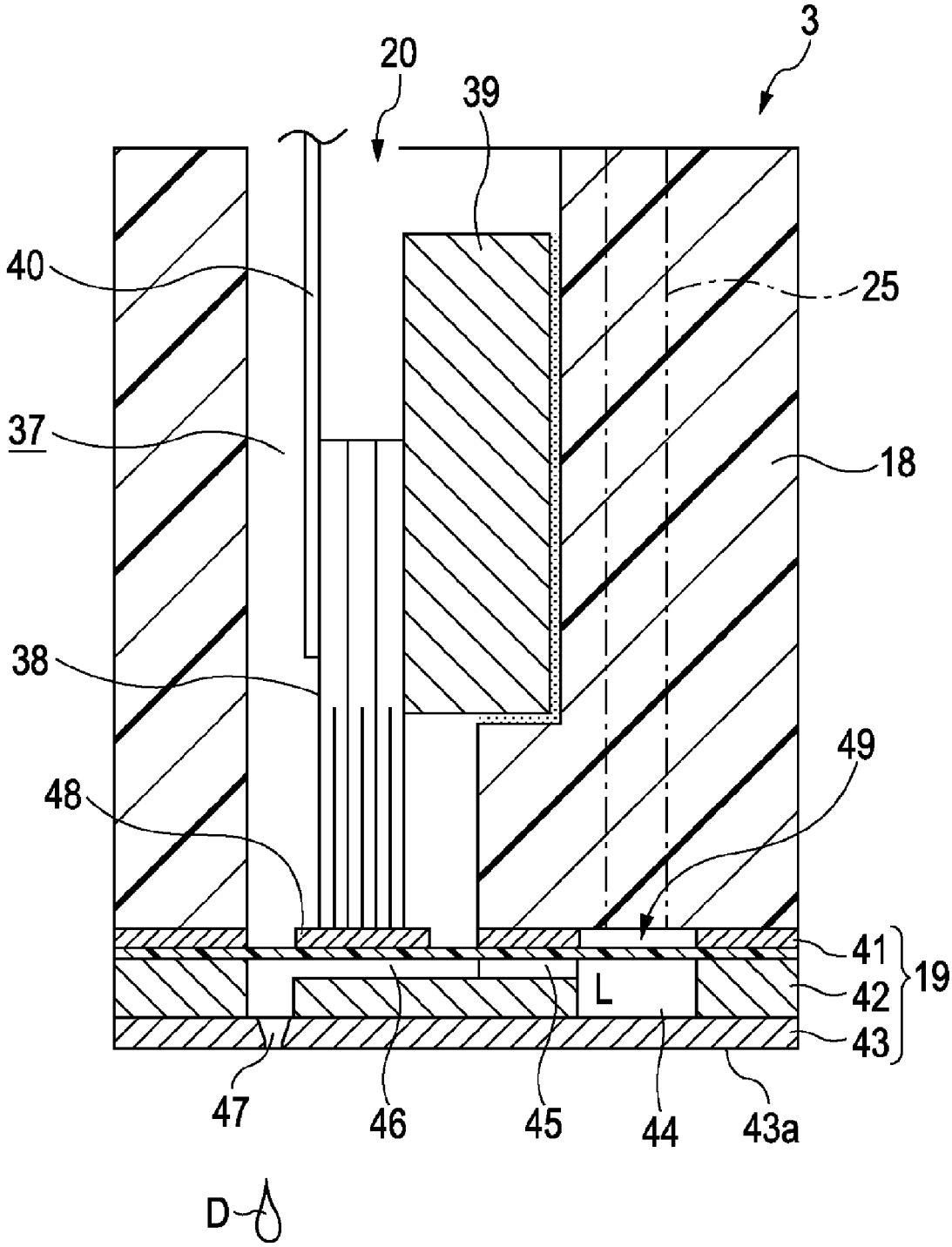
FIG. 3 is a main-part section view illustrating the configuration of the recording head.
Figure 4:
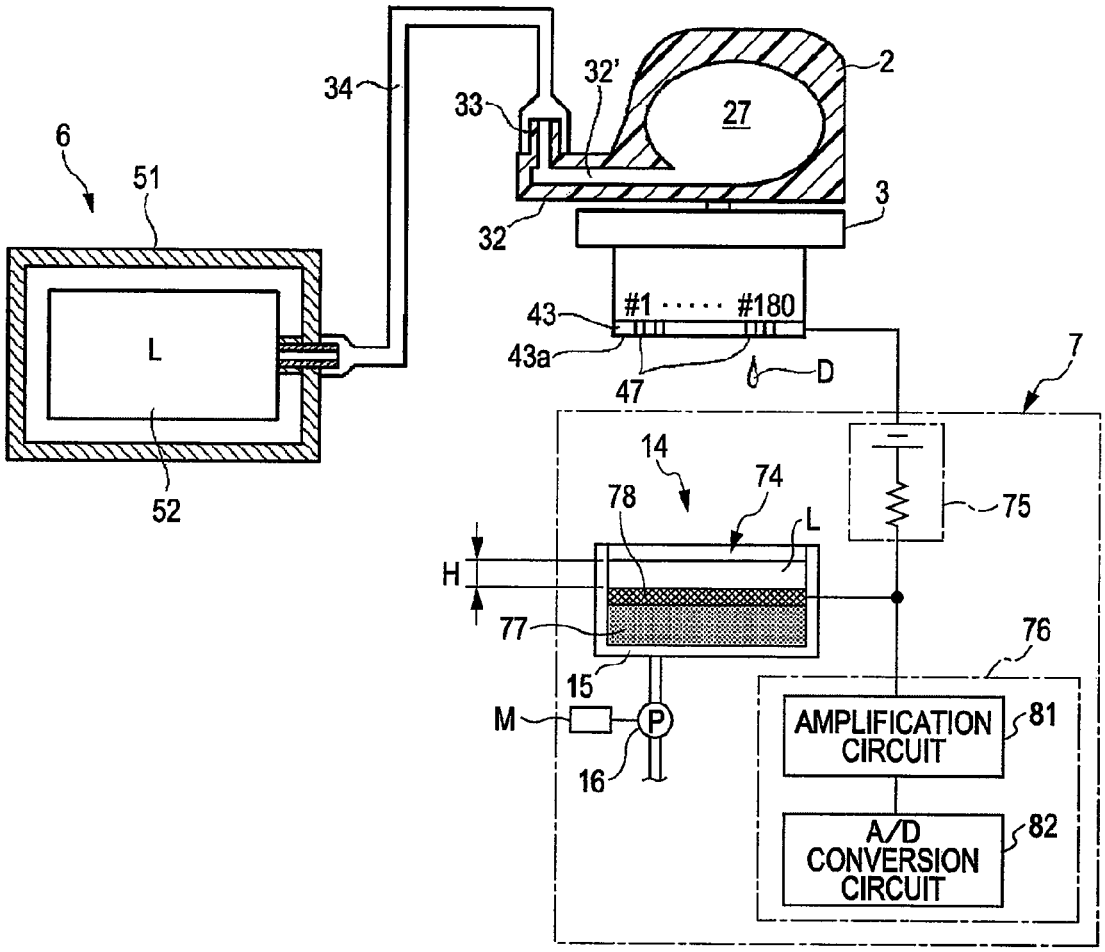
FIG. 4 is a schematic view illustrating configurations of a recording head, an ink cartridge, and an ink droplet sensor.

FIG. 2 is a section view illustrating the configuration of the recording head 3. FIG. 3 is a main-part section view of the recording head 3. FIG. 4 is a schematic view illustrating configurations of the recording head 3, the ink cartridge 6, and the ink droplet sensor 7.

The recording head 3 in the embodiment has, as main constituent elements, an introduction needle unit 17, a head case 18, a channel unit 19, and an actuator unit 20.

Two ink introduction needles 22 are attached to an upper face of the introduction needle unit 17 side by side, with filters 21 provided therebetween. The subtanks 2 are respectively mounted to the ink introduction needles 22. Also, in the introduction needle unit 17, ink introduction paths 23 corresponding to the ink introduction needles 22 are formed.

An upper end of each ink introduction path 23 communicates with each ink introduction needle 22 through each filter 21, and a lower end of the ink introduction path 23 communicates with each case channel 25 formed in the head case 18 through a packing 24.

Since the embodiment uses two inks, two subtanks are provided. However, obviously, the present invention is applied to a configuration in which three or more inks are used.

The subtanks 2 are molded from a resin material such as polypropylene. In each subtank 2, a depression that serves as an ink chamber 27 is formed. A transparent elastic sheet 26 is bonded to an opening face of the depression, whereby the ink chamber 27 is formed.

In addition, in a lower portion of each subtank 2, a needle connection portion 28 into which the ink introduction needle 22 is inserted is downwardly provided in a protruding manner. The ink chamber 27 in the subtank 2 is shallow, cone-shaped. At a position slightly below a horizontal center of a side of the ink chamber 27, an upstream opening of a connection channel 29 that communicates with the needle connection portion 28 is exposed. A tank-portion filter 30 that filtrates the ink L is attached to the upstream opening.

In an inside space of the needle connection portion 28, a seal member 31 into which the ink introduction needle 22 is inserted in a liquid-tight manner is fitted. As shown in FIG. 4, the subtank 2 has an extension portion 32 having a communicating groove 32' that communicates with the ink chamber 27, and, on an upper surface of the extension portion 32, an ink inlet 33 is provided in a protruding manner.

An ink supply tube 34 for supplying the ink L stored in the ink cartridge 6 is connected to the ink inlet 33. Accordingly, the ink L, which passes through the ink supply tube 34, flows from the ink inlet 33 to the ink chamber 27 through the communicating groove 32'.

The elastic sheet 26 can change in shape in a direction in which the ink chamber 27 contracts and in a direction in which the ink chamber 27 expands. A damper function by the shape change of the elastic sheet 26 absorbs a pressure change in the ink L. In other words, an operation of the elastic sheet 26 causes each subtank 2 to function as a pressure damper. Accordingly, the ink L is supplied to the side of the recording head 3, with the pressure change absorbed.

The head case 18 is a hollow box member made of synthetic resin. The channel unit 19 is bonded to a lower end face of the head case 18. The actuator unit 20 is accommodated in an accommodating portion 37 formed inside. The introduction needle unit 17 is attached to the head case 18, with the packing 24 provided on an upper end face opposing the side of the channel unit 19.

In the inside of the head case 18, each case channel 25 is provided penetrating a height. An end of the case channel 25 can communicate with the ink introduction path 23 in the introduction needle unit 17 via the packing 24.

A lower end of the case channel 25 can communicate with a common ink chamber 44 in the channel unit 19. Accordingly, the ink L, which is introduced from the ink introduction needle 22, is supplied to the common ink chamber 44 through the ink introduction path 23 and the case channel 25.

The actuator unit 20 accommodated in the accommodating portion 37 of the head case 18 includes a plurality of piezoelectric vibrators 38 arranged in the form of a comb, a fixed plate 39 to which the piezoelectric vibrators 38 are bonded, and a flexible cable 40 as a wiring member that supplies a driving signal from the printer body side to the piezoelectric vibrators 38. Each piezoelectric vibrator 38 has a fixed end side fixed to the fixed plate 39 and a free end side that protrudes outwardly from an end face of the fixed plate 39. That is, the piezoelectric vibrator 38 is attached to the fixed plate 39 in a cantilever state.

In addition, the fixed plate 39, which supports each piezoelectric vibrator 38 is formed of, for example, stainless steel having a thickness of approximately 1 mm. The actuator unit 20 is accommodated and fixed in the accommodating portion 37 by bonding a back face of the fixed plate 39 to an in-case wall surface delimiting the accommodating portion 37.

The channel unit 19 is formed in such a manner that channel-unit constituent elements including a diaphragm (sealing plate) 41, a channel substrate 42, and a nozzle substrate 43 are joined to one another with an adhesive in a state in which the channel-unit constituent elements are stacked so as to be integrated. The channel unit 19 is a member that forms a continuous ink channel (liquid channel) from the common ink chamber 44 to nozzles 47 through an ink supply port 45, and each pressure chamber 46. The pressure chamber 46 is formed as an elongated chamber perpendicularly to a direction (nozzle-row direction) in which the nozzles 47 are arranged in a row. In addition, the common ink chamber 44 communicates with the case channel 25. The ink L from the side of the ink introduction needle 22 is introduced into the common ink chamber 44.

The ink L introduced into the common ink chamber 44 is distributed to each pressure chamber 46 through the ink supply port 45.

The nozzle substrate 43, which is disposed on the bottom of the channel unit 19, is a thin metal plate on which the nozzles 47 are provided in rows in an open condition at a pitch (for example, 180 dpi) corresponding to a dot formation density. The nozzle substrate 43 in the embodiment is formed of a stainless steel plate material. In the embodiment, as rows of nozzles 47 (i.e., nozzle rows), a total of 22 rows of nozzles 47 are arranged in parallel so as to correspond to the subtanks 2. One nozzle row consists of 180 nozzles 47.

The channel substrate 42, which is disposed between the nozzle substrate 43 and the diaphragm 41, is a plate member in which a channel portion that becomes an ink channel, specifically, a hollow portion that becomes the common ink chamber 44, the ink supply port 45, and the pressure chamber 46, is defined.

In the embodiment, the channel substrate 42 is formed by performing anisotropic etching on a silicon wafer that is a crystalline base material. The diaphragm 41 is a double structure composite plate formed by laminating an elastic film on a support plate of a metal such as a stainless steel. In a portion of the diaphragm 41 which corresponds to the pressure chamber 46, the support plate is circularly removed by etching or the like, whereby an insular portion 48 to which an end face of the piezoelectric vibrator 38 is joined is formed. This portion functions as a diaphragm portion. In other words, the diaphragm 41 is configured so that the elastic film around the insular portion 48 can be elastically deformed in accordance with an operation of the piezoelectric vibrator 38. In addition, the diaphragm 41 seals one opening face of the channel substrate 42 and also functions as a compliance portion 49. Regarding a portion corresponding to the compliance portion 49, similarly to the diaphragm portion, only the elastic film is allowed to remain by removing the support plate with etching or the like.

In the above recording head 3, when a driving signal is supplied to the piezoelectric vibrator 38 through the flexible cable 40, the piezoelectric vibrator 38 expands or contracts in an element longitudinal direction. This accordingly causes the insular portion 48 to move close to or away from the pressure chamber 46. This changes the volume of the pressure chamber 46, so that a pressure change occurs in the ink L in the pressure chamber 46. The pressure change discharges the ink droplet D from the nozzle 47.

As shown in FIG. 4, the ink cartridge 6 includes a case member 51 formed having a hollow box form and an ink pack 52 formed of a plastic material. The ink pack 52 is accommodated in an accommodation chamber in the case member 51.

The ink cartridge 6 communicates with one end portion of the ink supply tube 34. The ink cartridge 6 is configured so that a water head difference between the ink cartridge 6 and the nozzle opening face 43*a* of the recording head 3 can supply the ink L in the ink pack 52 to the side of the recording head 3. Specifically, a positional relationship in weight direction between the ink cartridge 6 and the recording head 3 is set to be in a state in which an extremely small negative pressure is applied to a meniscus of the nozzle 47.

A pressure change caused by driving the piezoelectric vibrator 38 performs supply of the ink L to the pressure chamber 46 and discharge of the ink L in the pressure chamber 46.

As shown in FIG. 4, the ink droplet sensor 7 includes the cap member 15 as a liquid droplet receiver disposed at the home position, an inspection region 74 provided in the cap member 15, a voltage applying circuit 75 that applies a voltage between the inspection region 74 and the nozzle substrate 43 of the recording head 3, and a voltage detecting circuit 76 that detects a voltage of the inspection region 74.

The cap member 15 is a tray-shaped member having an open upper face and is formed of a member of elastic material such as elastomer. In the cap member 15, an ink absorber 77 is provided. The ink absorber 77 has high retention of the ink L, and is formed of, for example, nonwoven fabric such as felt.

On an upper face of the ink absorber 77, a mesh electrode member 78 is provided. A surface of the electrode member 78 corresponds to the inspection region 74. The electrode member 78 is formed as latticed mesh formed of metal such as stainless steel. Accordingly, the ink droplet D, which has landed at the electrode member 78, can be absorbed and retained in the absorber 77, which is disposed below the electrode member 78, through openings of the electrode member 78 in lattice form.

The voltage applying circuit 75 electrically connects, via a direct current power supply (for example, 400 V) and a resistance element (for example, 1 MΩ), the electrode member 78 and the nozzle substrate 43 of the recording head 3 so that the electrode member 78 is a positive electrode and the nozzle substrate 43 of the recording head 3 is a negative electrode.

The voltage detecting circuit 76 includes an amplification circuit 81 that amplifies and outputs a voltage signal of the electrode member 78, and an A/D conversion circuit 82 that performs A/D conversion on a signal output from the amplification circuit 81 and outputs a converted signal to the side of a printer controller 55. The amplification circuit 81 amplifies and outputs the voltage signal of the electrode member 78 at a predetermined amplification factor. The A/D conversion circuit 82 can convert an analog signal output from the amplification circuit 81 into a digital signal and can output the digital signal as a detection signal to the side of the printer controller 55.

Figure 5:
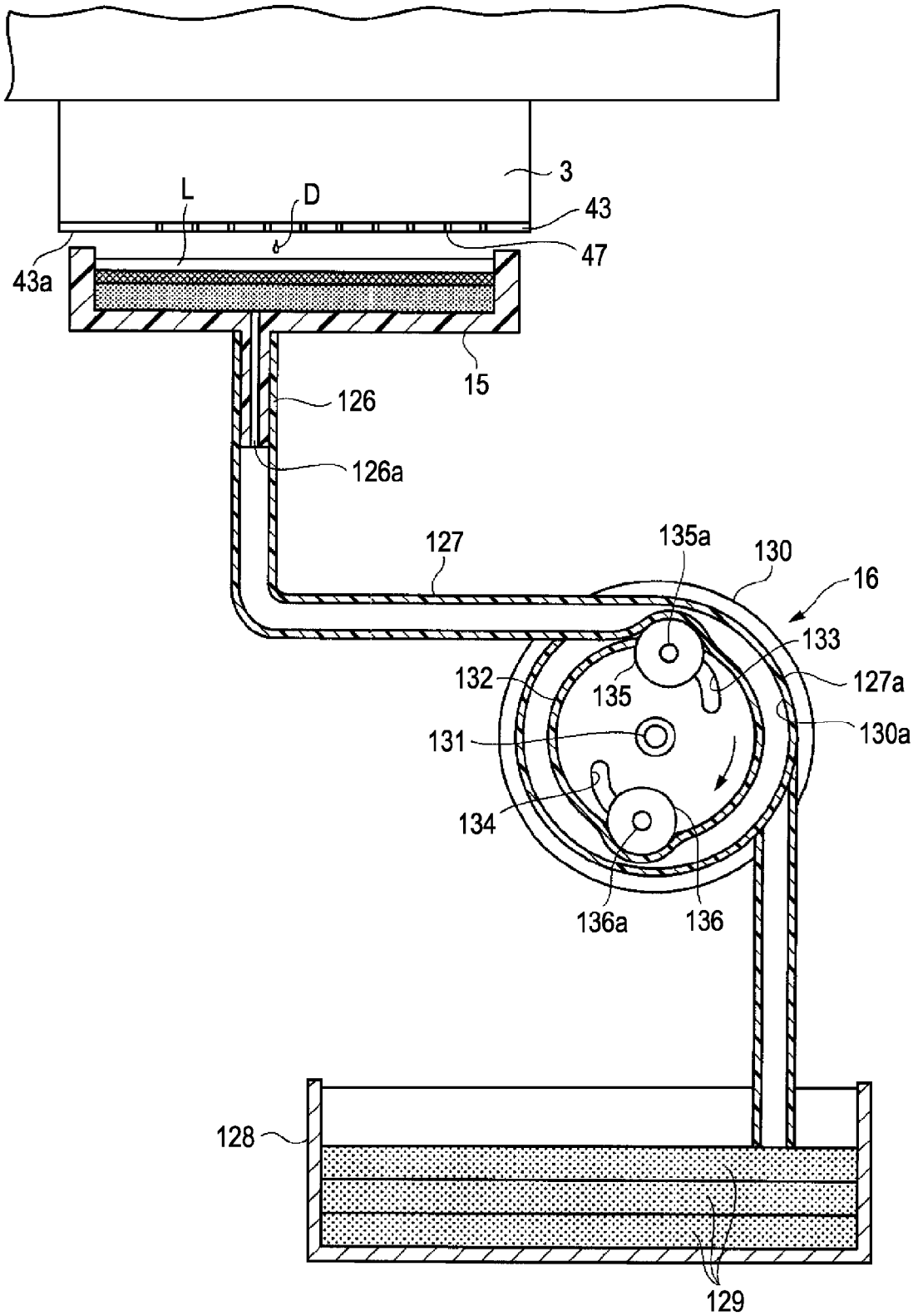
FIG. 5 is an illustration showing the configuration of a suction pump connected to a cap member.

FIG. 5 is an illustration showing the configuration of a suction pump 16 connected to the cap member 15.

In a bottom wall of the cap member 15, a drain portion 126 for draining the ink L, which is collected in the cap member 15, is downwardly provided in a protruding manner. In the drain portion 126, a drain path 126*a* is formed.

One end portion of a drain tube 127 formed of a flexible material or the like is connected to the drain portion 126, and the other end portion of the drain tube 127 is inserted into a waste ink tank 128.

In the waste ink tank 128, a waste ink absorber 129 formed of a porous member is accommodated, and the waste ink absorber 129 can absorb the ink L, which has been collected. The waste ink tank 128 is provided below the platen 13.

A tube-pump suction pump 16 is provided between the cap member 15 and the waste ink tank 128. The suction pump 16 has a cylindrical case 130. In the case 130, a pump wheel 132 that is circular in a plan view is accommodated so as to rotate around a wheel shaft 131 provided at the shaft center of the case 130. In the case 130, an intermediate portion 127*a* of the drain tube 127 is accommodated along an inner circumferential wall 130*a*.

In the pump wheel 132, a pair of roller guiding grooves 133 and 134 each having an outwardly extending arc shape is formed so that both oppose each other, with the wheel shaft 131 provided therebetween. Each of the roller guiding grooves 133 and 134 has one end positioned on the outer circumferential side of the pump wheel 132, and the other end positioned on the inner circumference side of the pump wheel 132. In other words, each of the roller guiding grooves 133 and 134 extends so as to gradually move away from the outer circumference of the pump wheel 132 as the distance from the one to the other end increases.

In the roller guiding grooves 133 and 134, rollers 135 and 136 as pressing means, which form a pair, are supported such that they are inserted into rotating shafts 135*a* and 136*a*. The rotating shafts 135*a* and 136*a* can slide in the roller guiding grooves 133 and 134, respectively.

When the pump wheel 132 is rotated in a forward direction (the arrow direction), both rollers 135 and 136 move to ends (the outer circumferential side of the pump wheel 132) of the roller guiding grooves 133 and 134. The pump wheel 132 can rotate while sequentially squeezing (pressing) the intermediate portion 127*a* of the drain tube 127 from an upstream side to a downstream side. This rotation can reduce the pressure of the inside of the drain tube 127 on an upstream side with respect to a tube pump 123.

Accordingly, the ink L that collects in the cap member 15 can be gradually discharged to the direction of the waste ink tank 128 by a forward rotation operation of the pump wheel 132.

In addition, when the pump wheel 132 is rotated in a reverse direction (the direction opposite to the arrow direction), both rollers 135 and 136 can move to the other end side (the inner circumferential side of the pump wheel 132) of the roller guiding grooves 133 and 134. This movement causes both rollers 135 and 136 to slightly touch the intermediate portion 127*a* of the drain tube 127, whereby the reduced pressure state in the inside of the drain tube 127 can be canceled.

The pump wheel 132 can be driven to rotate by the paper feeding motor M of the paper feeding mechanism 66.

Figure 6:
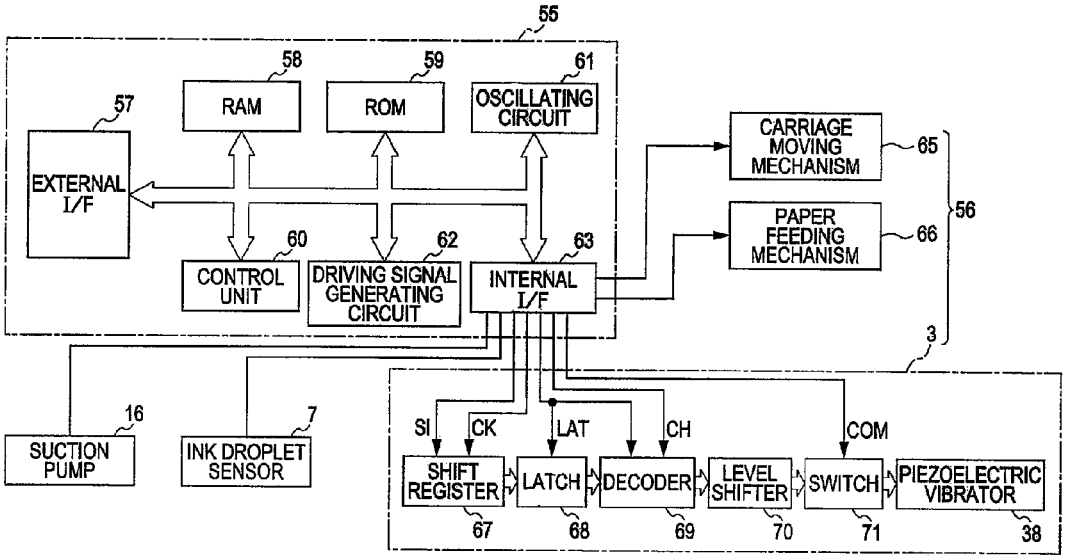
FIG. 6 is a block diagram illustrating an electrical configuration of a printer.

FIG. 6 is a block diagram showing an electric configuration of the printer 1.

The printer 1 in the embodiment broadly includes the printer controller 55, a print engine 56, and the ink droplet sensor 7.

The printer controller 55 includes an external interface (external I/F) 57 to which print data or the like from an external apparatus such as a host computer is input, a RAM 58 for storing various types of data, etc., a ROM 59 storing a control program for various types of control, etc., a control unit 60 for performing overall control of each portion in accordance with a control program stored in the ROM 59, an oscillating circuit 61 for generating a clock signal, a driving signal generating circuit 62 for generating a driving signal to be supplied to the recording head 3, and an internal interface (internal I/F) 63 for outputting, to the recording head 3, discharge data obtained by expanding print data for each dot, driving signals, etc.

The print engine 56 includes the recording head 3, the carriage moving mechanism 65, and the paper feeding mechanism 66.

The recording head 3 includes a shift register 67 in which discharge data is set, a latch circuit 68 that latches the discharge data set in the shift register 67, a decoder 69 that generates pulse selection data by translating the discharge data from the latch circuit 68, a level shifter 70 that functions as a voltage amplifier, a switch circuit 71 that controls supply of a driving signal to the piezoelectric vibrator 38, and the piezoelectric vibrator 38.

The control unit 60 expands print data transmitted from the external apparatus to discharge data corresponding to a dot pattern, and transmits the discharge data to the recording head 3. The recording head 3 is configured to discharge the ink droplet D on the basis of received discharge data.

In addition, the control unit 60 also functions as a flushing processing unit on the basis of flushing conditions stored in the ROM 59. In the flushing processing, by discharging the ink L, whose viscosity is increased, or bubbles from each nozzle 47 of the recording head 3, nozzle clogging is prevented. Discharge of the ink droplet D is performed a predetermined number of times from each nozzle 47 to the cap member 15.

The flushing processing includes so-called pre-printing flushing that is performed before a recording operation by the recording head 3 is started after power is supplied to the printer 1. The pre-printing flushing is set so that, for example, discharge of the ink droplet D is performed 3000 to 5000 times from all the nozzles 47. The flushing conditions are stored in the ROM 59.

Also, in addition to the pre-printing flushing, the flushing processing includes so-called periodic flushing that is performed during the recording operation by the recording head 3. The flushing processing further includes paper-feeding-time flushing that is performed when recording paper is supplied toward the recording head 3, and paper-expelling-time flushing that is performed immediately after recording paper is expelled.

In the periodic flushing, the paper-feeding-time flushing, and the paper-expelling-time flushing, the number of times discharge is performed is set to, for example, approximately several tens of times to several hundreds of times.

Further, the control unit 60 functions also as an idle suction processing unit (maintenance processing unit) that implements so-called idle suction processing in which, when a predetermined amount of the ink L collects in the cap member 15, the tube-pump suction pump 16 is driven to discharge the ink L toward the waste ink tank 128.

The idle suction processing is processing in which, since the ink L collects in the cap member 15 after the pre-printing flushing, the periodic flushing, or the like, is performed a plural number of times, the ink L is sucked and discharged so that the ink L is prevented from overflowing the cap member 15.

The driving signal generating circuit 62 receives data that represents an amount of change in voltage of a discharge pulse to be supplied to the piezoelectric vibrator 38 of the recording head 3 and a timing signal that defines timing at which the voltage of the discharge pulse is changed, and generates a driving signal (discharge pulse) on the basis of the data and the timing signal.

By applying the discharge pulse DP to the piezoelectric vibrator 38, the ink droplet D is discharged in the following manner. Specifically, when the discharge pulse is supplied, first, the piezoelectric vibrator 38 contracts and the pressure chamber 46 expands. After this expansion state of the pressure chamber 46 is maintained for an extremely short time, the piezoelectric vibrator 38 rapidly extends. In accordance therewith, the volume of the pressure chamber 46 contracts to be not greater than a reference volume, so that a meniscus exposed at the nozzle 47 is rapidly pressurized to the exterior. This discharges a predetermined liquid amount of the ink droplet D from the nozzle 47. After that, the pressure chamber 46 returns to the reference volume so that meniscus vibration caused by discharge of the ink droplet D is allowed to converge.

The printer 1 having the above-described configuration is controlled so that, when the ink L collects in the cap member 15 after the flushing processing is performed, before the ink L overflows, the suction pump 16 is driven to discharge the ink L (idle suction processing).

As described above, since the suction pump 16 is driven by the paper feeding motor M, the idle suction processing needs to be performed in a state in which recording processing (printing) including paper feeding and expelling is stopped. Therefore, it is required that, by storing the ink L in the cap member 15 as much as possible, a frequency of the idle suction processing be reduced.

A method for reducing the frequency of the idle suction processing in the case of maintenance processing such as flushing will be described below.

FIG. 7 is a flowchart illustrating maintenance processing using the ink droplet sensor 7.

Figure 8:
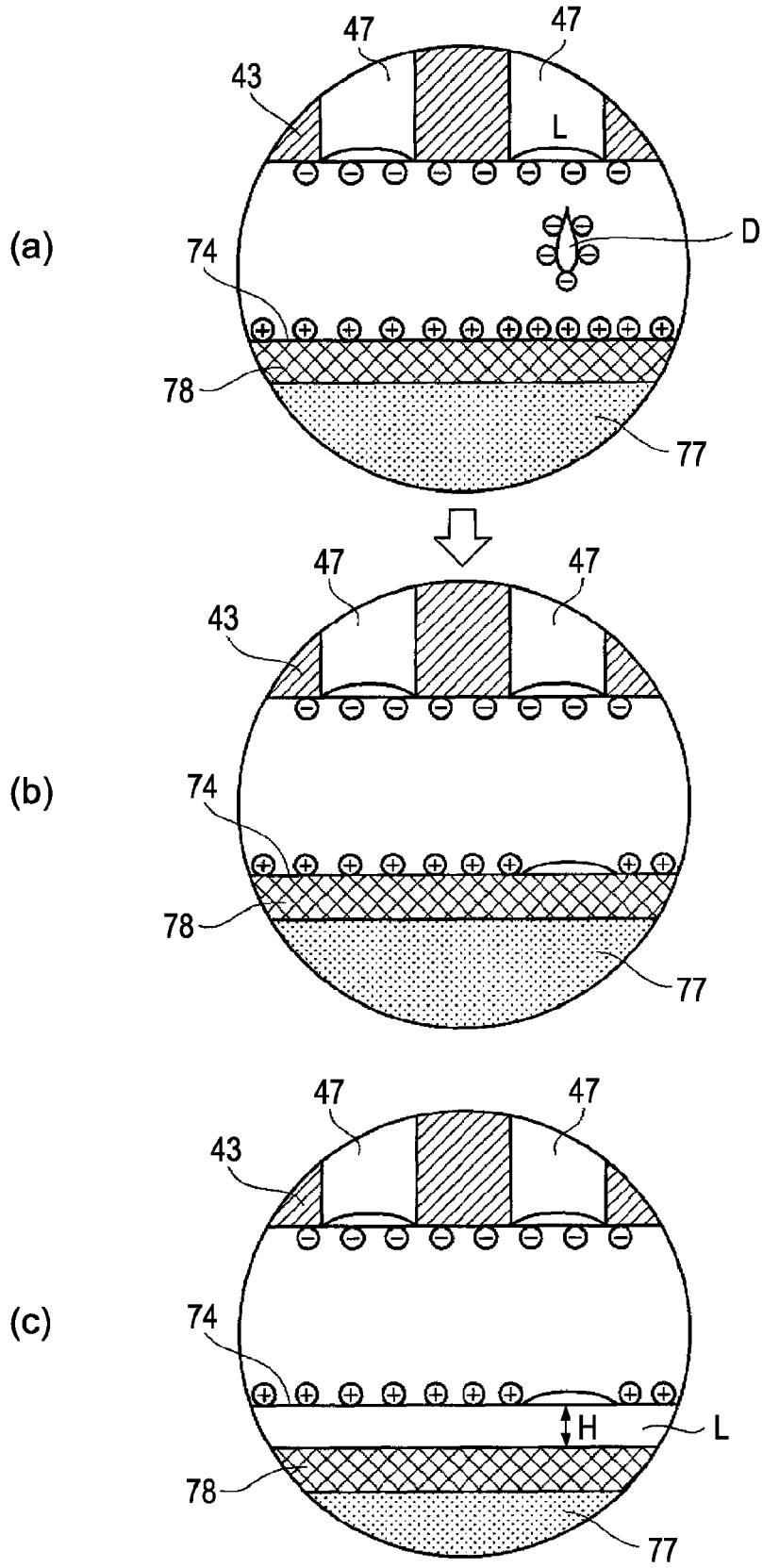
FIG. 8 consists of schematic views illustrating a principle in which induced voltage is generated by electrostatic induction.

FIG. 8 consists of schematic diagrams illustrating the principle of generation of induced voltage by electrostatic induction. (a) is a diagram showing a state immediately after the ink droplet D is discharged. (b) is a diagram showing a state in which the ink droplet D has landed in the inspection region 74 of the cap member 15. (c) is a diagram showing a state in which the ink droplet D has landed when the ink L collects in the cap member 15.

Figure 9:
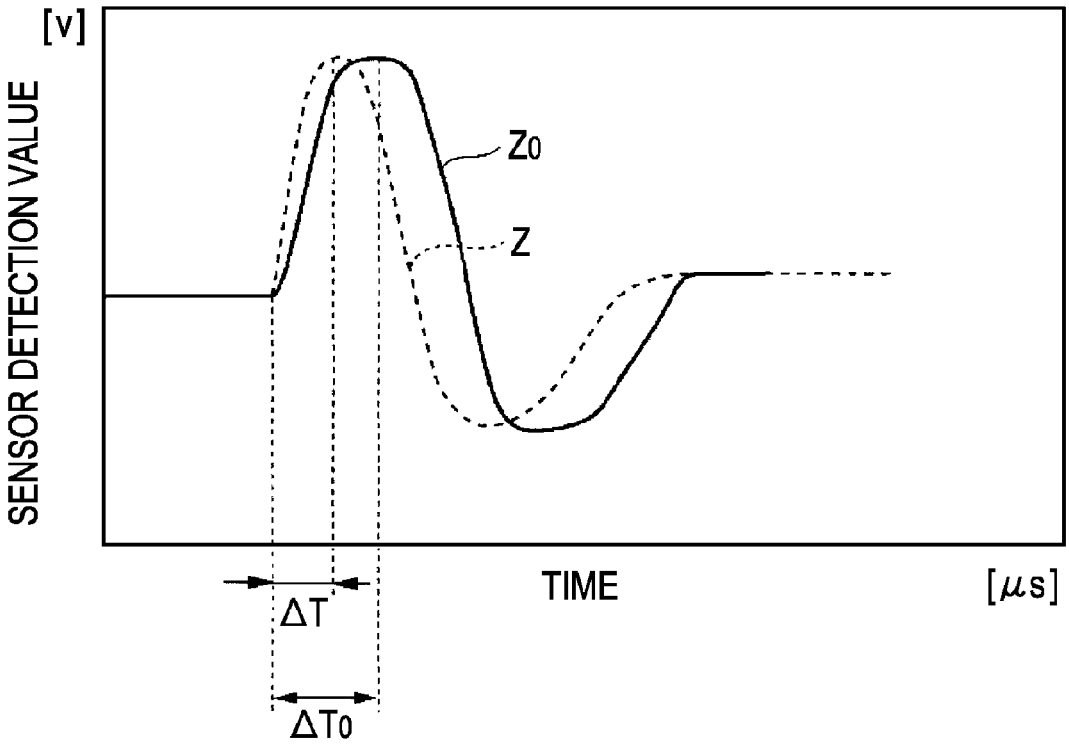
FIG. 9 is a graph showing a waveform example of a detection signal output from the ink droplet sensor.

FIG. 9 is a graph showing an example of a waveform of the detection signal (for one droplet of ink) output from the ink droplet sensor 7.

After print data is transmitted from the external apparatus, the control unit 60 expands the print data to discharge data corresponding to a dot pattern and transmits the discharge data to the recording head 3. On the basis of the discharge data, which is received, the recording head 3 executes recording processing (printing), that is, discharge of the ink droplet D onto recording paper (step S1).

If a preset time (periodic flushing time interval) has elapsed during the recording processing (step S2), the recording processing is interrupted and the periodic flushing processing is started.

In the periodic flushing processing, first, the carriage 4 is driven to move the recording head 3 to the home position, whereby the recording head 3 is positioned above the cap member 15.

Next, by raising the cap member 15 by using an elevating mechanism, which is not shown, the nozzle opening face 43*a* of the recording head 3 and the inspection region 74 (the electrode member 78) are allowed to be close to and face each other (step S3) in a non-contact state.

A voltage is applied between the nozzle substrate 43 and the electrode member 78 by the voltage applying circuit 75 (step S4).

Next, in a state in which the voltage is applied between the nozzle substrate 43 and the electrode member 78, by driving the piezoelectric vibrator 38, an ink droplet D is discharged from any one nozzle (for example, #A1) among the nozzles 47 (step S5).

At this time, the nozzle substrate 43 is a negative electrode. Thus, as shown in FIG. 8(*a*), part of negative charge of the nozzle substrate 43 moves to the ink droplet D, and the ink droplet D discharged is negatively charged. As the ink droplet D approaches the inspection region 74 of the cap member 15, positive charge increases in the inspection region 74 (the surface of the electrode member 78) in accordance with electrostatic induction. This causes the voltage between the nozzle substrate 43 and the electrode member 78 to be higher than an initial voltage value in a state in which the ink droplet D is not discharged, due to an induced voltage generated by electrostatic induction.

After that, as shown in FIG. 8(*b*), after the ink droplet D lands at the electrode member 78, the negative charge of the ink droplet D neutralizes the positive charge of the electrode member 78. Accordingly, the voltage between the nozzle substrate 43 and the electrode member 78 is less than the initial voltage value.

After that, the voltage between the nozzle substrate 43 and the electrode member 78 returns to the initial voltage value.

Therefore, as shown in FIG. 9, regarding a detection waveform output from the ink droplet sensor 7, after the voltage temporarily rises, it drops until it is less than the initial voltage value, and subsequently returns to the initial value.

As described above, a voltage change in a case where the ink droplet D is discharged from the nozzle 47 (for example, #A1) is detected by using the ink droplet sensor 7 (step S6).

In a case where the periodic flushing or the like has been performed a plural number of times, as shown in FIG. 8(*c*), the ink L collects in the cap member 15. In this case, a time (landing time) after the ink droplet D moves away from the recording head 3 until it lands in the ink droplet sensor 7 (the inspection region 74) is shorter than that in a case where the ink L does not collect.

When the landing time is shorter, also the detection waveform output from the ink droplet sensor 7 changes. This is because the level of the ink L collected in the cap member 15 is charged and becomes the inspection region 74.

The landing time of the ink droplet D corresponds to a time until, in the detection waveform, the voltage begins to increase (a voltage change occurs) and reaches its peak. Accordingly, as shown in FIG. 9, time ΔT of detection waveform Z in a case where the ink L collects is shorter than ΔT0 of detection waveform Z0 in a case where the ink L does not collect (initial stage).

The level of the liquid and the landing time are proportional to each other. Thus, from landing time ΔT of detection waveform Z output from the ink droplet sensor 7, a liquid level height H (see FIG. 8(*c*)) of the ink L collected in the cap member 15 is found (step S7).

In addition, a liquid level height in a case where, for example, the ink L collects in the cap member 15, occupying approximately 95% of its capacity limit, and a landing time ΔTx obtained in the case are found beforehand, and the landing time ΔTx is set as a threshold value. By comparing this threshold value (ΔTx) and the landing time ΔT, it is determined whether or not the ink L collected in the cap member 15 should be discharged (the idle suction processing) (step S8).

Next, in a case where the liquid level height H of the ink L collected in the cap member 15 is lower than a liquid level height obtained when the ink L collects (that is, the landing time ΔT is longer than ΔTx) occupying approximately 95% of the capacity limit, the periodic flushing processing is executed (step S10).

On the other hand, in a case where the liquid level height H of the ink L collected in the cap member 15 is not less than a predetermined height (that is, the landing time ΔT is within ΔTx), after the idle suction processing (step S9) is temporarily executed to discharge all the ink L collected in the cap member 15, the periodic flushing processing is performed (step S10).

After the periodic flushing processing is completed, the recording head 3 returns to the recording processing again. In the recording processing, determination of whether or not the recording processing is to be completed (step S11) and determination of whether or not the periodic flushing processing is to be performed (step S2) are repeated.

As described above, according to the maintenance method in the embodiment, from the landing time ΔT of the detection waveform Z output from the ink droplet sensor 7, the liquid level height H of the ink L collected in the cap member 15 can be determined. Thus, it is possible to sufficiently utilize the amount of ink capacity of the cap member 15.

Conventionally, the liquid amount of the ink L collected in the cap member 15 is estimated from the number of times discharging is performed. Thus, at worst, to prevent the ink L from overflowing the cap member 15, in the case of estimating that an amount of the ink L which is, for example, approximately 80% of the capacity limit of the cap member 15 has collected, the idle suction processing is performed (that is, a safety factor is set to be high).

Conversely, in the maintenance method in the embodiment, the ink capacity of the cap member 15 can be sufficiently utilized. Thus, a frequency of the idle suction processing can be reduced than before.

Specifically, conventionally, whenever the periodic flushing is performed, for example, 20 times, the idle suction processing is performed. However, in the maintenance method in the embodiment, it is only necessary to perform the idle suction processing whenever the periodic flushing is performed, for example, 30 times.

As described above, by reducing the frequency of the idle suction processing, a frequency (printing) and time of interrupting the recording processing is reduced, thus increasing the efficiency of the recording processing. In addition, since the frequency of the idle suction processing is reduced, an improvement in durability is achieved.

The above embodiment describes a case where, whenever the periodic flushing is performed, the liquid level height H of the ink L collected in the cap member 15 is determined on the basis of the detection waveform output from the ink droplet sensor 7.

However, since the amount of the ink L that collects in the cap member 15 is small when the periodic flushing is performed once, as described below, a frequency of determining the liquid level height H may be minimized.

Figure 10:
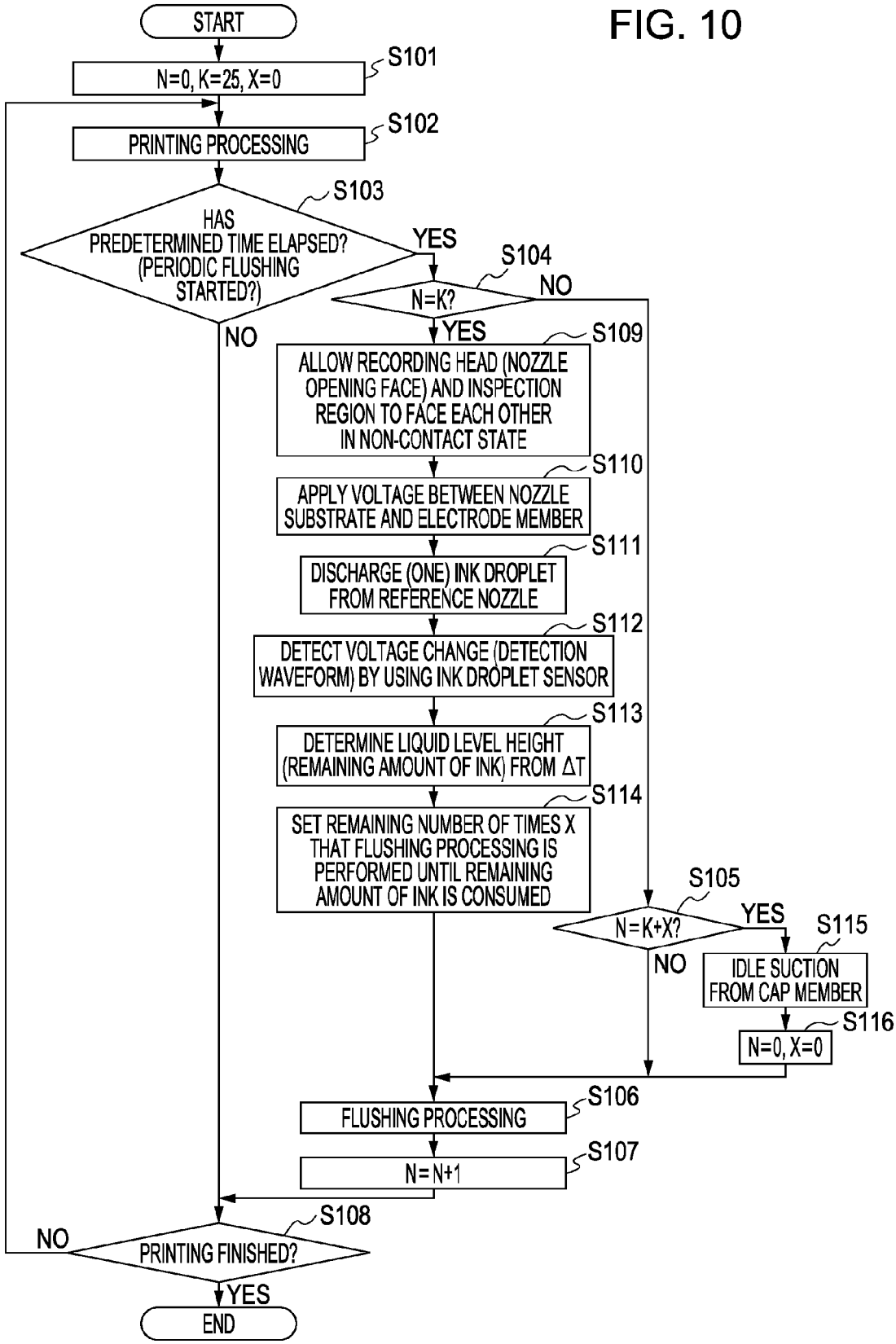
FIG. 10 is a flowchart illustrating another example of the maintenance process using the ink droplet sensor.

FIG. 10 is a flowchart illustrating another example of the idle suction processing using the ink droplet sensor 7.

Regarding processing identical to the above-described processing, its description will be simplified or omitted. In addition, in the following description, a case where processing is started from an empty state of the cap member 15 will be described.

First, a counter N for counting the number of times the periodic flushing is performed is initialized (N=0).

In addition, for example, in the case of the 26th flushing processing (after the flushing processing is performed 25 times), in order for the liquid level height H of the ink L collected in the cap member 15 to be determined by using the ink droplet sensor 7, the number of times K that flushing has been performed is set so that K=25.

Further, the remaining number of times X that flushing is to be performed is set so that X=0 (step S101).

These values are stored in the RAM 58. The recording processing (step S102) is performed, and it is determined whether or not the periodic flushing time interval has elapsed (step S103). If the periodic flushing time interval has elapsed, the recording processing is interrupted and a periodic flushing step is started.

In the periodic flushing step, it is determined whether or not the counter N represents 25 (K) (step S104).

If the counter N represents a value less than 25, furthermore, it is determined whether or not N=25+0 (N=K+X) (step S105).

If both determination results are negative, the flushing processing (step S106) is directly executed. One is added to the counter N (N=0+1) (step S107).

After the periodic flushing processing is completed, the recording head 3 returns to the recording processing again. In the recording processing, determination of whether or not the recording processing is to be finished (step S108) and determination of whether or not the periodic flushing is to be performed (step S103) are repeated.

In the case of the 2nd to 25th (N=0 to 24) lushing steps, processing is executed as described above.

If it has been determined that the present step is the 26th flushing step (step S104), processing (steps S109 to S113) that determines the liquid level height H of the ink L collected in the cap member 15 by using the ink droplet sensor 7 is performed. These steps are identical to the above-described steps S3 to S7.

When the liquid level height H of the ink L is found, at the same time, a remaining ink capacity amount (that is, how much the ink L can collect in the cap member 15) of the cap member 15 is found.

Next, for the found remaining ink capacity amount, it is determined how many times the flushing processing can be performed (in other words, how many times the flushing processing should be performed to cause the cap member 15 to be full with the ink L (so that the ink L does not overflow)). This number of times (for example, 5 times) is set as the remaining number of times X that the flushing processing is performed (X=5) (step S114).

The 26th periodic flushing processing is executed (step S106), and one is added to the counter N (step S107).

The 26th to 30th lushing steps are performed similarly to the 1st to 24th lushing processing.

If it has been determined that the present flushing step is the 31st flushing step (N=25+5) (step S105), the idle suction processing (step S115) is started. This discharges the ink L from the cap member 15 before the ink L overflows (before the 31st flushing processing).

The counter N and the remaining number of times X that the flushing processing is performed are initialized (step S116). After the periodic flushing processing (step S106) and counter addition (step S107) are performed, the recording head 3 returns to the recording processing.

As described above, after the periodic flushing processing is performed a plural number of times, liquid-level-height detection is performed to predict a subsequent increase in liquid level height, whereby a frequency of detection by using the ink droplet sensor 7 can be minimized.

Compared with a case where, from initial flushing processing, a subsequent increase in liquid level height is predicted as in a conventional manner, a difference between the prediction and actuality is reduced. Thus, by causing a more amount of the ink L to collect in the cap member 15, a frequency of executing the idle suction processing can be reduced.

By using, as a reference, the number of times the periodic flushing processing is performed, timing for executing liquid-level-height detection by using the ink droplet sensor 7 is set to optimize (reduce a frequency) timing for executing the idle suction processing. However, the number of times (amount of liquid) of the ink droplet D may be used as a reference.

In other words, by using, as a reference, the number of times (amount of liquid) the ink droplet D is discharged to the cap member 15, when this number of times (amount) reaches a preset number of times (amount), liquid-level-height detection is performed. Further, instead of finding the remaining ink capacity amount of the cap member 15 and subsequently determining the remaining number of times the flushing processing is performed, a remaining number of times discharging is performed and a remaining amount of liquid can be determined.

This enables a much more amount of the ink L to further collect in the cap member 15, so that the frequency of the idle suction processing can be reduced.

In addition, the case where processing is started from a state in which the cap member 15 is empty has been described. However, in a case where processing is started from a state in which the ink L collects in the cap member 15 after flushing is performed a plural number of times, it is preferable that, in the first flushing processing, liquid-level-height detection by using the ink droplet sensor 7 be performed. Alternatively, the number of times flushing has already been performed may be stored in the RAM 58, and the stored number may be input to the counter N.

Although, in the above-described embodiment, various limitations are used as preferred specific examples, the present invention is not limited thereto. The present invention can be variously modified on the basis of the description in Claims.

In the above-described embodiment, a case where, when the periodic flushing processing is performed, the liquid level height of the ink L collected in the cap member 15 is detected by using the ink droplet sensor 7 has been described. However, the present invention is not limited thereto.

In the cases of the pre-printing flushing that is performed before the recording (printing) is started, and the paper-feeding-time flushing and the paper-expelling-time flushing that are performed when paper is fed and expelled, liquid-level-height detection by using the ink droplet sensor 7 may be performed.

In addition, a case where the number of times the periodic flushing processing is performed is counted has been described. However, also the number of times flushing processing (the paper-feeding-time flushing and the paper-expelling-time flushing) is irregularly performed may be counted.

In addition, the liquid-level-height detection by using the ink droplet sensor 7 is not limited to a case where the number of times the flushing processing is performed or the number of times (amount of liquid) an ink droplet is discharged is used as a reference. At worst, before timing at which the ink L collected in the cap member 15 is likely to overflow, liquid-level-height detection may be performed a minimum of once. For example, whenever a predetermined time elapses, liquid-level-height detection by using the ink droplet sensor 7 may be performed. This makes it possible to accurately determine a remaining ink capacity amount of the cap member 15, so that idle suction processing on the cap member 15 can be optimized (frequency can be reduced).

In addition, the above-described embodiment describes a case where determination of the idle suction processing is performed by using, as a reference (threshold value), a liquid level height obtained when the ink L collects in the cap member 15, occupying approximately 95% of its capacity limit. This reference (threshold value) may be changed in accordance with a type of flushing processing.

For example, the case of the paper-expelling-time flushing processing has a state immediately after the recording paper is expelled (printing is not being performed). Thus, after detecting the liquid-level height, the idle suction processing can be directly performed. Therefore, the liquid level height as the reference (threshold value) may be set to be higher (for example, 97%) than that in the case of other flushing processing.

In addition, in accordance with an installation state of the printer 1, the liquid level height as the reference (threshold value) may be set. When the printer 1 is installed, with it inclined, the liquid level height as the reference (threshold value) is set to, for example, 90%.

In addition, the above-described embodiment exemplifies a configuration in which the cap member 15 in the capping mechanism 14 is used as the liquid droplet receiver in the present invention. However, the liquid droplet receiver is not limited thereto, and a separate liquid droplet receiver dedicated for discharging inspection may be provided.

In addition, the above-described embodiment shows an example in which the electrode member 78 and the nozzle substrate 43 of the recording head 3 are electrically connected to each other so that the electrode member 78 is a positive electrode and the nozzle substrate 43 is a negative electrode. However, the positive and negative polarities of both can be reversed.

In addition, the above-described embodiment describes a case where the tube-pump suction pump 16 (the pump wheel 132) is driven to rotate by the paper feeding motor M of the paper feeding mechanism 66. However, the embodiment is not limited to the case. A motor for driving the tube-pump suction pump 16 and the paper feeding motor M may differ from each other.

In addition, the tube-pump suction pump 16 is not limited to a tube pump, and another type of pump may be used.

In addition, in the above-described embodiment, the piezoelectric vibrator 38 having a so-called length-extension-vibration mode is exemplified as a pressure generator in the present invention. However, the pressure generator is not limited thereto. For example, the pressure generator may also be a piezoelectric vibrator capable of vibration in an electric field direction (direction in which a piezoelectric substance and an internal electrode are stacked). Also, the pressure generator is not limited to piezoelectric vibrators unitized for each nozzle row. The pressure generator may be one provided for each pressure chamber 46, as a piezoelectric vibrator having a so-called flexural oscillation mode. Further, not only the piezoelectric vibrator, but also another pressure generating element, such as a heater element, may be used.

In the above-described first and second embodiments, a case where an ink jet recording apparatus is the printer 1 has been described as an example. However, the ink jet recording apparatus is not limited to the ink jet printer, and may be an ink jet recording apparatus for use in copying machines and facsimile machines.

Although each above-described embodiment exemplifies a case where the liquid ejecting apparatus is a liquid ejecting apparatus that ejects liquid such as ink, the liquid ejecting apparatus of the present invention is applicable to a liquid ejecting apparatus that ejects or discharges a different liquid other than ink. Liquids that can be ejected by the liquid ejecting apparatus include a liquid material in which particles of a high-performance material are dispersed or dissolved, and a granular material in gel form.

In each above-described embodiment, as the liquid (the liquid material or the granular material), not only ink, but also a liquid corresponding to a particular use is applicable. By providing the liquid ejecting apparatus with an ejecting head capable of ejecting the liquid corresponding to the particular use, ejecting the liquid corresponding to the particular use from the ejecting head, and causing the liquid to adhere to a predetermined object, a predetermined device can be produced. For example, the liquid ejecting apparatus (liquid material ejecting apparatus) of the present invention is applicable to liquid ejecting apparatuses that eject liquid (liquid material) in which materials, such as electrode materials and coloring materials, used in uses such as production of liquid crystal displays, EL (electroluminescent) displays, and surface-emitting displays (FED), are dispersed (dissolved) in a predetermined dispersion medium (solvent).

In addition, types of the liquid ejecting apparatus may include a liquid ejecting apparatus for ejecting a living organic material for use in production of biochips and a liquid ejecting apparatus which is used as a precision pipet and which ejects a liquid serving as a sample.

Furthermore, the types of the liquid ejecting apparatus may include a liquid ejecting apparatus that ejects lubricant to a precision machine such as a clock or a camera in a pinpoint manner, a liquid ejecting apparatus that ejects, on a substrate, transparent resin liquid, such as ultraviolet curing resin, for forming a microhemispherical lens (optical lens) for use in optical communication elements or the like, a liquid ejecting apparatus that ejects an etching solution, such as an acid or alkali, for etching a substrate or the like, a fluid material ejecting apparatus that ejects gel, and a toner recording apparatus that ejects a solid, for example, powder such as a toner. In addition, if there is a possibility that, among these, in any one type of liquid ejecting apparatus, liquid (liquid material, fluid material) to be ejected may have a viscosity increased due to drying or the like, the present invention can be applied to the type of liquid ejecting apparatus.

What is claimed is:

1. A maintenance method for a liquid ejecting apparatus that ejects liquid from a nozzle of a liquid ejecting head to a liquid receiver and that, when a predetermined amount of the liquid collects in the liquid receiver, discharges the predetermined amount of the liquid, the maintenance method comprising:

in a state in which a nozzle opening face of the liquid ejecting head is disposed facing the liquid receiver in a non-contact manner, applying an electric field between the nozzle opening face and the liquid receiver;

ejecting the liquid from the nozzle to the liquid receiver;

detecting a voltage change based on electrostatic induction occurring when the liquid is ejected to the liquid receiver;

determining the height of the level of the liquid collected in the liquid receiver on the basis of a result of detection of the voltage change; and when the level of the liquid reaches a predetermined height, discharging the liquid collected in the liquid receiver.

2. The maintenance method according to claim 1, wherein the height of the level of the liquid is determined on the basis of the voltage change in a case where the voltage change occurs when the liquid ejected from the nozzle lands in the liquid receiver.

3. The maintenance method according to claim 2, wherein the height of the level of the liquid is determined on the basis of a time taken after the voltage change occurs until a voltage peak is reached.

4. The maintenance method according to claim 1, wherein the application of the electric field, the ejection of the liquid, the detection of the voltage, and the determination of the height of the level of the liquid are performed after the liquid ejected to the liquid receiver reaches an amount set beforehand.

5. The maintenance method according to claim 1, further comprising, between the determination of the height of the level of the liquid and the discharge of the liquid, performing flushing that continuously ejects the liquid from the liquid ejecting head to the liquid receiver, wherein, in the performing of the flushing, the amount of liquid that can be ejected and/or the number of times the liquid can be ejected before the predetermined height is reached are/is determined.

6. The maintenance method according to claim 5, wherein, in the performing of the flushing, the flushing is performed periodically and/or aperiodically a plural number of times.

7. The maintenance method according to claim 6, wherein, in the performing of the flushing, the number of times the flushing can be performed before the predetermined height is reached is determined.

8. The maintenance method according to claim 5, wherein, in the performing of the flushing, in a case where the flushing is performed at a discharging time, the predetermined height is set to be higher compared with other cases for other types of flushing.

9. A liquid ejecting apparatus that ejects liquid from a nozzle of a liquid ejecting head to a liquid receiver and that, when a predetermined amount of the liquid collects in the liquid receiver, discharges the predetermined amount of the liquid, the liquid ejecting apparatus comprising:

a liquid detecting unit that, in a state in which a nozzle opening face of the liquid ejecting head is disposed facing the liquid receiver in a non-contact manner, applies an electric field between the nozzle opening face and the liquid receiver;

a flushing unit that continuously ejects the liquid from the liquid ejecting head to the liquid receiver;

a liquid discharging unit that discharges the liquid collected in the liquid receiver; and a maintenance unit that determines the height of the level of the liquid collected in the liquid receiver on the basis of a result of detection of a voltage change, and that drives the liquid discharging unit when the level of the liquid reaches a predetermined height.

10. The liquid ejecting apparatus according to claim 9, wherein the maintenance unit determines the height of the level of the liquid on the basis of the voltage change in a case where the voltage change occurs when the liquid ejected from the nozzle lands in the liquid receiver.

11. The liquid ejecting apparatus according to claim 10, wherein the height of the level of the liquid is determined on the basis of a time taken after the voltage change occurs until a voltage peak is reached.

12. The liquid ejecting apparatus according to claim 9, wherein the maintenance unit determines the amount of liquid that can be ejected and/or the number of times the liquid can be ejected before the predetermined height is reached.

13. The liquid ejecting apparatus according to claim 9, wherein the flushing unit continuously ejects the liquid to the liquid receiver periodically and/or aperiodically a plural number of times.

14. The liquid ejecting apparatus according to claim 13, wherein the maintenance unit determines the number of times the flushing can be performed before the predetermined height is reached, and drives the liquid discharging unit on the basis of the number of times the flushing can be performed.

* * * * *